United States Patent [19]

Lipka

[11] Patent Number: 5,047,602

[45] Date of Patent: Sep. 10, 1991

[54] PRESSURE-SENSITIVE MAT-FORM ELECTRIC SWITCHING ELEMENT

[75] Inventor: Karel Lipka, Weiningen, Switzerland

[73] Assignee: G. Bopp & Co. AG, Zurich, Switzerland

[21] Appl. No.: 521,669

[22] Filed: May 10, 1990

[30] Foreign Application Priority Data

May 17, 1989 [DE] Fed. Rep. of Germany ..... 3915989

[51] Int. Cl.[5] ..... H01H 35/00; H01H 3/02

[52] U.S. Cl. ..... 200/86 R; 200/85 R

[58] Field of Search ..... 200/86 R, 85 R, 511, 200/512; 340/665, 666; 29/825, 622

[56] References Cited

U.S. PATENT DOCUMENTS 4,524,256 6/1985 Miyata et al. ..... 200/86 R 4,661,664 4/1987 Miller ..... 299/86 R

*Primary Examiner*—Harold Broome

*Attorney, Agent, or Firm*—Tarolli, Sundheim & Covell

[57] ABSTRACT

The movable electrode of the switching element consists of a flexible compressible contact-mesh comprising conducting and non-conducting wires. The conducting wires extend in the first direction of weaving and are arranged essentially straightlined in a plane. On the other hand, said non-conducting wires, which extend in the other direction of weaving, are bent around said conducting wires, thereby keeping said conducting wires at some distance from a flat electrode contacting said contact-mesh. When said contact-mesh is compressed said conducting wires are flexibly deformed, whereby the wave crests formed on said conducting wires are reaching the surfaces of said contact-mesh and are contacting there said flat electrode.

12 Claims, 1 Drawing Sheet

PRESSURE-SENSITIVE MAT-FORM ELECTRIC SWITCHING ELEMENT

FIELD OF THE INVENTION

This invention refers to a pressure-sensitive mat-form electric switching element comprising a flat electrode and a flexible movable electrode formed by a grid of conducting wires, which flexible electrode can be brought in contact with said flat electrode by applying pressure against an elastic resetting force.

BACKGROUND OF THE INVENTION

A known switching element of this kind is disclosed in U.S. Pat. No. 4,524,256. It comprises, as a movable electrode, a contact-mesh, said contact-mesh consisting exclusively of metallic wires which extend undulated in both weaving directions. This contact-mesh is embedded in an elastic insulating layer which rises above the bare wave crests, thereby keeping them in distance of an adjacent flat electrode. Upon compressing said insulating layer the wave crests of the wires are moved to the surface of the insulating layer, thereby contacting said flat electrode. As soon as the compression is stopped, the resetting forces of the elastic insulating layer make the contact-mesh to move into its original position in distance of the flat electrode.

Manufacture of this switching element is relatively expensive. A foamed material is used as the insulating layer. After embedding the contact-mesh, the insulating material is to be mechanically removed down to the surface of the fabric. Thereafter, the insulating material is foamed by heat-treatment in order to uncover the wave crests and to increase the effective thickness of the insulating layer as compared with the fabric thickness. A further disadvantage of the insulating layer is that its elasticity may decrease due to aging, thereby altering the pressure-sensitivity and imparing the function of the switching element.

Another switching element, fundamentally based on the same principles, is described in the publication DE-A1-34 24 060. The wires of the contact-mesh are provided with an insulating layer which is to be removed at the wave crests. For this, a chemical process is proposed which is to be applied after the mechanical removal of the elastic insulating material. By this additional process step the manufacturing expenses are further increased.

SUMMARY OF THE INVENTION

An object of the present invention is to eliminate the disadvantages of the prior art described above, and to provide an electric switching element of the kind described above which can be produced at a lower price.

In order to accomplish this object, according to the present invention, the movable electrode of the switching element consists of a flexible compressible contact-mesh comprising conducting and non-conducting wires and lying on said flat electrode. The conducting wires extend in the first direction of weaving and are arranged essentially straight-lined in a plane. On the other hand, said non-conducting wires, which extend in the other direction of weaving, are bent around said conducting wires, thereby keeping said conducting wires at some distance from a flat electrode contacting said contact-mesh. When said contact-mesh is compressed said conducting wires are flexibly deformed, whereby the wave crests formed on said conducting wires are reaching the surface of said contact-mesh and are contacting there said flat electrode.

With this solution, the conducting wires themselves take the function of resetting, due to their bending elasticity. By a suitable choice of the wire material and, if necessary, by artificially aging said contact-mesh, a switching element having highly stable switching properties can be produced.

Due to the absence of additional spreaders, a simple structure and a flat construction is achieved.

The wire gauge, which controls the thickness of said contact-mesh, first of all depends on the desired actuation pressure of the switching element. Contact-meshes according to the invention can be woven from wires of a wide gauge range, so that switching elements can be manufactured, both for high actuation pressures, e.g. mats or sills which may be walked on or driven on, and for extremely low actuation pressures, e.g. contact keys or contact keybords. In particular, the invention allows to manufacture pressure-sensitive mat-form electric switching elements the thickness of which is as low as a few tenths of a millimeter.

The switching poles may be formed by two flat electrodes which upon application of pressure are bridged by a contactmesh arranged between them. In another embodiment, the contact-mesh itself may be one of the switching poles which cooperates with only one flat electrode, said flat electrode being arranged either on the pressurized side of said contact-mesh, or on the opposite side. Alternatively, said contact-mesh may cooperate with a plurality of flat electrodes arranged on the same side of it. This arrangement provides a switching element with several switching functions, which e.g. is suitable for electric keybords.

In a preferred embodiment of the switching element according to the invention, the contact-mesh lies on a stable pad and is covered by a flexible covering coating which transfers the pressure applied from outside to said contact-mesh and protects the latter against disturbing influences coming from outside. Said flexible covering coating may be e.g. a foil made of an electrically non-conducting plastic material.

If necessary, said foil may by laminated, on the side directed towards the contact-mesh, with a contact metal, e.g. copper. Additionally, a fine-meshed, electrically conducting protecting fabric may be laminated into said plastic foil for being kept at a fixed potential in order to protect any contacting elements and contacting arrangements situated below said covering coating against the influence of electric or electromagnetic interfering radiation.

The stable pad may consist of, or may comprise, at least one flat electrode, as well.

Preferably, the conducting wires of said contact-mesh are made of metal, e.g. copper, and the non-conducting wires are made of plastic, e.g. a polyester. Alternatively, the metallic wires may consist of a center material of very high bending elasticity which is covered by a contact material.

In order to keep the bending stress of the electrically conducting wires within the region of elasticity, the ratio of the aperture width of said contact-mesh bears to the mean diameters of the conducting and non-conducting wires, which mean diameters are almost the same, should preferably be from about 3:1 to about 8:1.

The actuation pressure of the switching element can by influenced by rolling the contact-mesh. By such an after-treatment, the actuation pressure may be risen or lowered, depending on the wire gauge and aperture width. At the same time, rolling provokes an artificial aging of said contact-mesh as it enlarges the bearing surfaces at the crossing points of said conducting and non-conducting wires. This results in more stable switching properties of the switching element. Alternatively, artificial aging can be carried out by heat-treatment, or it may be convenient to use simultaneous rolling and heat-treatment.

PREFERRED EMBODIMENTS OF THE INVENTION

Now, two preferred embodiment of the present invention will be described with reference to the drawings.

Figure 2:
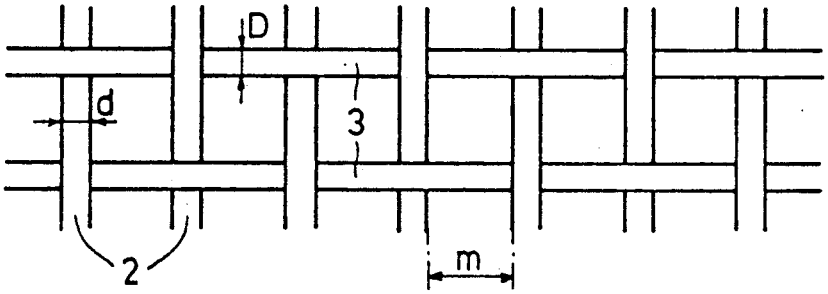
FIG. 2 is a top view of the contact-mesh of FIG. 1.
Figure 3:
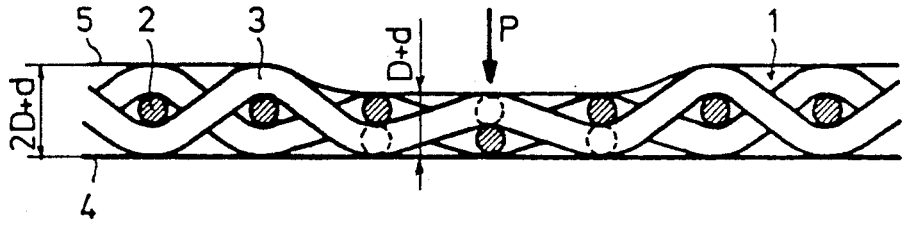
FIG. 3 is a sectional view of the structure of FIG. 1 under the action of pressure.

The movable electrode of the electric switching element is a flexible contact-mesh 1 comprising electrically conducting wires 2, extending in the first direction of weaving, and electrically non-conducting wires 3, extending in the other direction of weaving. Said electrically conducting wires 2, of diameter d, are arranged essentially straight-lined in a plane, whereas said electrically non-conducting wires 3, of diameter D, are bent around said conducting wires 2 and are keeping them at some distance from said flat electrode 4. With this kind of weaving, the thickness of said contact-mesh 1 is 2D+d (FIG. 3). The aperture width m (FIG. 2) is chosen so as to give ratio d/m, or D/m respectively, of 3:1. In manufacturing this contact-mesh, it is convenient to make the straight-lined wires 2 the weft and the intensely bent wires 3 the wrap of the fabric.

When a pressure is created by, applying a force P, the conducting wires 2 are undulated by the non-conducting wires 3, as shown in FIG. 3. The wave crests formed on said conducting wires 2 are reaching the surface of said contact-mesh and are contacting there said flat electrode 4. In the area of pressure, the thickness of said contact-mesh 1 is reduced from 2D+d to D+d. A flexible covering coating 5 transfers the pressure applied from outside to said contact-mesh 1 thereby protecting said flexible contact-mesh 1 against disturbing influences coming from outside, such as dust and humidity.

Preferably, the thickness of the flexible covering coating 5 is chosen so as to distribute the pressure on a plurality of meshes, thereby creating an area of pressure which at all events is larger than shown in the schematic view of FIG. 3.

The diameters d and D of the wires and the aperture width m are chosen in a manner that the excursion of said conducting wires 2, upon execution of the switching operation, is kept within the region of elasticity, so that said conducting wires 2 take again their distance from said flat electrode 4 and their original elongated form when the pressure is released.

Tests carried out on practical embodiments showed that a flexible contact-mesh consisting of a copper wire of a diameter d of 0.22 mm and a polyester wire of a diameter D of 0.16 mm and having an aperture width m of 3:1 provides a switching element, the actuation pressure of which is 2.5 to 3.0 MPa (25 to 30 kg/cm$^2$). By reducing the diameter of the copper wire to 0.112 mm, without change of the other parameters, the actuation pressure may be reduced to 0.8 MPa (8 kg/cm$^2$).

Figure 1:
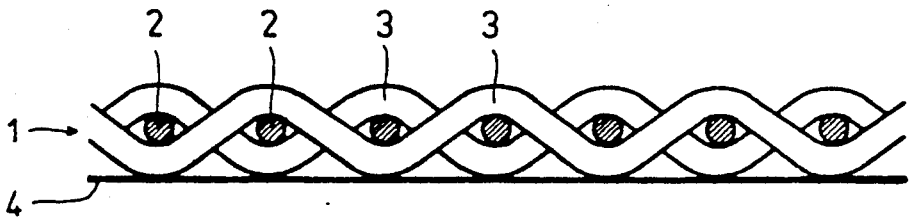
FIG. 1 is a sectional view of the fundamental structure of a contact-mesh according to the present invention, in combination with a flat electrode.
Figure 4:
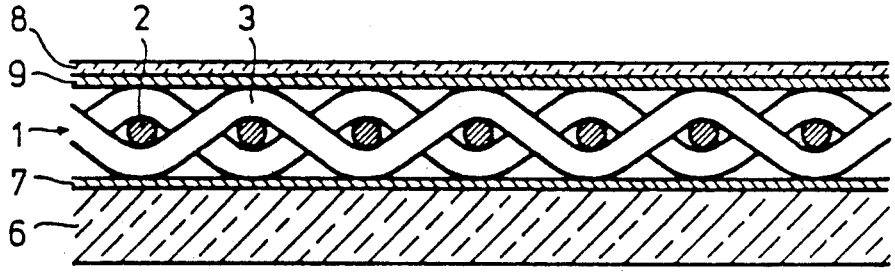
FIG. 4 is a sectional view of a first embodiment of a switching element according to the invention.
Figure 5:
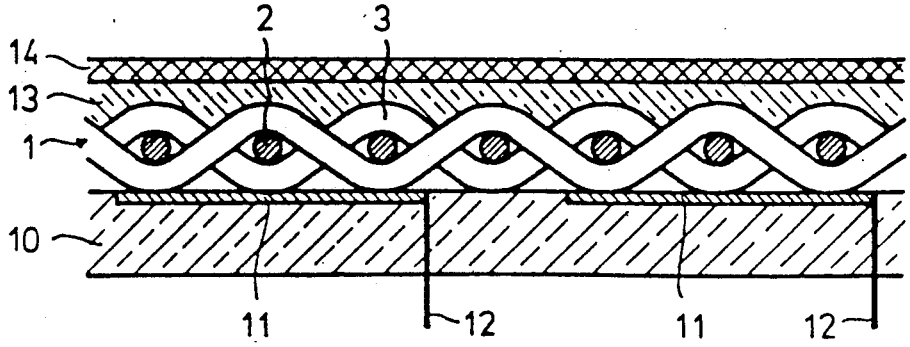
FIG. 5 is a sectional view of a second embodiment of a switching element according to the invention.

The switching element of FIG. 4 comprises a contact-mesh 1 of the kind described with reference to FIGS. 1 to 3. Said contact-mesh 1 lies on a stable pad 6 of insulating material which comprises a flat electrode consisting of a metallic coating. The covering coating is a foil 8 of insulating material, provided with a metallic coating 9 as well. Both said metallic coatings 7 and 9 face the flexible contact-mesh 1, and are connected to each other by said conducting wires 2 when the contact-mesh is compressed as shown in FIG. 3.

Alternatively, said conducting wires 2 may be connected to each other e.g. at the edge of the fabric, thereby jointly forming a switching pole. In this case, one of the metallic coatings 7 and 9, this is to say one of the flat electrodes, may be omitted.

The switching element shown in FIG. 3 comprises the same type of contact-mesh 1 and a stable pad 10 of insulating material as well. Several flat electrodes 11 (two of which are shown in the drawing) which are connected to separate conductors 12 are provided for on said stable pad 10. The movable electrode is common to all flat electrodes 11 since all conducting wires 2 of said contact-mesh 1 are interconnected (not shown). The movable electrode may alternatively be contacted with one of the flat electrodes 11 by locally and selectively applying pressure so as to limit the area of pressure to the area of one of the flat electrodes 11. The covering coating is a plastic laminate 13 which is laminated into a fine-meshed protecting screen 14 consisting of metal.

What is claimed is:

1. A pressure-sensitive mat-form electric switching element comprising:

a flat electrode;

a flexible movable electrode which can be brought into contact with said flat electrode by applying pressure against an elastic resetting force;

said flexible movable electrode being formed by a compressible contact-mesh composed of conducting and non-conducting wires and lying on said flat electrode;

said conducting wires, which are extending in the first direction of weaving, being arranged essentially in a plane; and said non-conducting wires, which are extending in the other direction of weaving, being bent around said conducting wires and keeping said conducting wires at some distance from said flat electrode;

so that when said flexible contact-mesh is compressed said conducting wires are flexiblely deformed, whereby the wave crests formed on said conducting wires are reaching the surface of said contact-mesh and are contacting there said flat electrode.

2. A pressure-sensitive element according to claim 1, wherein said flexible contact-mesh lies on a stable pad, and wherein a flexible covering coating is arranged on said contact-mesh in order to transfer to said contact-mesh the pressure applied from outside for making contact, and to protect said contact-mesh against disturbing influences coming from outside.

3. A pressure-sensitive element according to claim 2, wherein said flexible covering coating is a foil consisting of an electrically non-conducting plastic material.

4. A pressure-sensitive element according to claim 3, comprising a fine-meshed electrically protecting fabric laminated into said electrically non-conducting plastic foil, in order to protect contacting elements and contacting arrangements situated below said covering coating against the influence of electric or electromagnetic interfering radiation.

5. A pressure-sensitive element according to claim 2, wherein said stable pad and/or said covering coating comprise at least one flat electrode.

6. A pressure-sensitive element according to claim 1, wherein said conducting wires of said flexible contact-mesh are made of a metal, and wherein said non-conducting wires of said flexible contact-mesh are made of a plastic material.

7. A pressure-sensitive element according to claim 6, wherein said conducting wires of said flexible contact-mesh are made of copper.

8. A pressure-sensitive element according to claim 6, wherein said non-conducting wires of said flexible contact-mesh are made of a polyester material.

9. A pressure-sensitive element according to claim 6, wherein the ratio which the aperture width of said contact-mesh bears to the mean diameters of the conducting and non-conducting wires, which mean diameters are almost the same, is from about 3:1 to about 8:1, in order to keep the bending stress of the electrically conducting wires within the region of elasticity.

10. A process for manufacturing a pressure-sensitive mat-form electric switching element comprising a flat electrode, a flexible movable electrode which can be brought into contact with said flat electrode by applying pressure against an elastic resetting force, said flexible movable electrode being formed by a compressible contact-mesh composed of conducting and non-conducting wires and lying on said flat electrode, said conducting wires, which are extending in the first direction of weaving, being arranged essentially in a plane, and said non-conducting wires, which are extending in the other direction of weaving, being bent around said conducting wires and keeping said conducting wires at some distance from said flat electrode so that when said flexible contact-mesh is compressed said conducting wires are flexiblely deformed, whereby the wave crests formed on said conducting wires are reaching the surface of said contact-mesh and are contacting there said flat electrode, said process comprising the step of artificially aging said contact-mesh in order to obtain stable contacting properties.

11. A process according to claim 10, wherein the step of artificial aging is done by rolling said contact-mesh.

12. A process according to claim 10, wherein the step of artificial aging is done by heat-treating said contact-mesh.

* * * * *